United States Patent [19]

Dively

[11] 4,076,238

[45] Feb. 28, 1978

[54] AMUSEMENT DEVICE

[75] Inventor: Robert M. Dively, Port Matilda, Pa.

[73] Assignee: The Raymond Lee Organization, Inc., New York, N.Y. ; a part interest

[21] Appl. No.: 801,227

[22] Filed: May 27, 1977

[51] Int. Cl.[2] ..... A63F 9/00

[52] U.S. Cl. ..... 273/1 R

[58] Field of Search ..... 273/1 R, 1 E, 1 M

[56] References Cited

U.S. PATENT DOCUMENTS 3,081,999 3/1963 Harris ..... 273/1 R 3,955,814 5/1976 Shallenberger ..... 273/1 R

*Primary Examiner*—Paul E. Shapiro

*Attorney, Agent, or Firm*—Daniel Jay Tick

[57] ABSTRACT

A handle member consists of a hollow elongated shaft having a tapered bore formed therein in the area of an end thereof. A balance member consists of an elongated rod tapered at one end to seat in the bore. A balance device is affixed to the opposite end of the rod. The user attempts to balance the balance member upright in the bore of the handle member and stores the balance member in the handle member when not in use.

1 Claim, 5 Drawing Figures

AMUSEMENT DEVICE

BACKGROUND OF THE INVENTION

The present invention relates to an amusement device.

Objects of the invention are to provide an amusement device of simple structure, which is inexpensive in manufacture, and functions to provide entertainment, interest, amusement, and recreation for a user and onlookers alike.

BRIEF DESCRIPTION OF THE DRAWINGS:

In order that the invention may be readily carried into effect, it will now be described with reference to the accompanying drawings, wherein.

Figures 1, 2, 3, 4, 5:
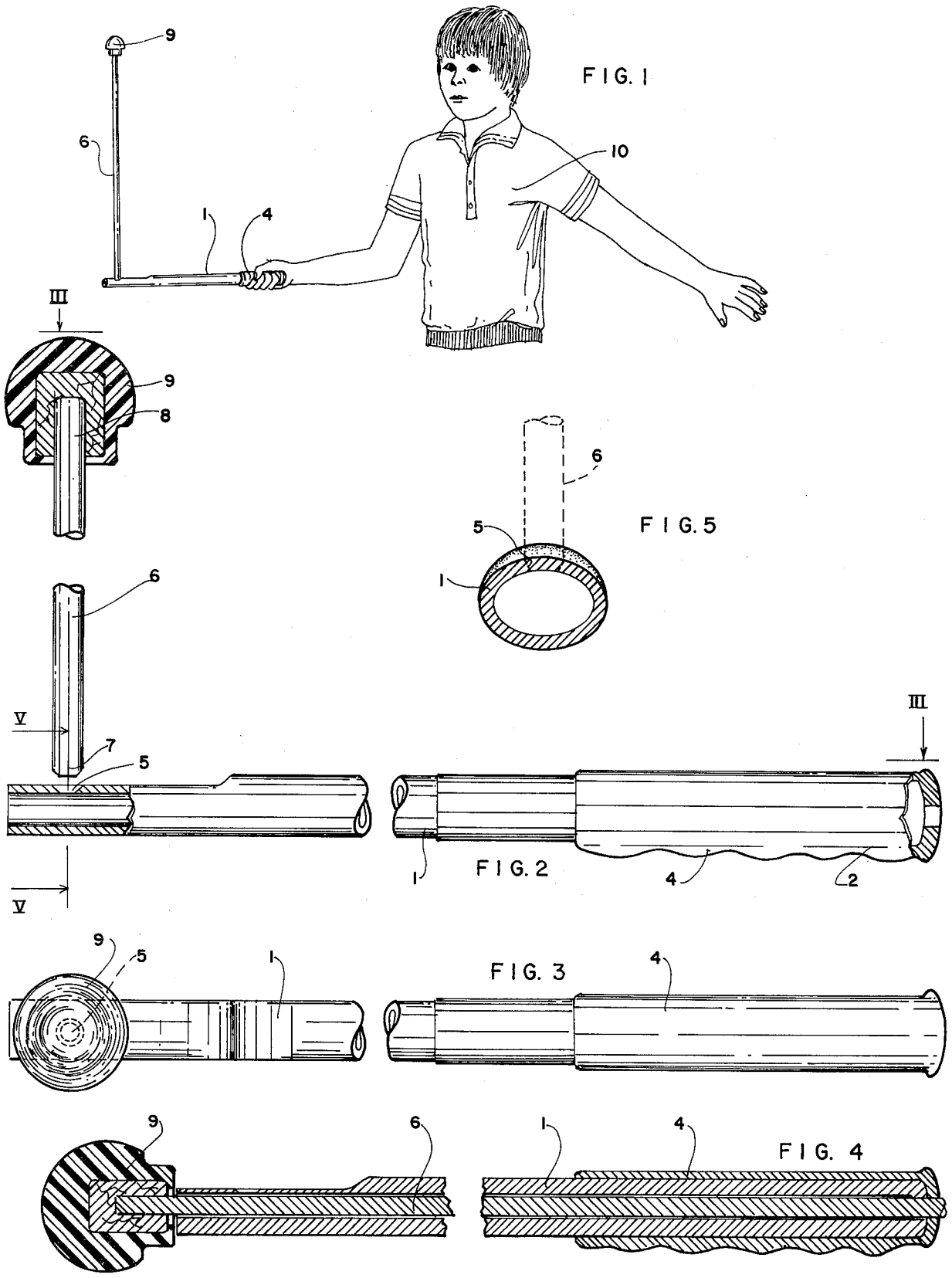
FIG. 1 is a view of an embodiment of the amusement device of the invention in use.
FIG. 2 is a view, on an enlarged scale, partly cut away and partly in section, of the embodiment of FIG. 1.
FIG. 3 is a view, taken along the lines III—III, of FIG. 2.
FIG. 4 is a cross-sectional view illustrating the storage of the balance member in the handle member.
FIG. 5 is a cross-sectional view, on an enlarged scale, taken along the lines V—V, of FIG. 2.

DETAILED DESCRIPTION OF THE INVENTION:

The amusement device of the invention comprises a handle member 1 (FIGS. 1 to 5) having a hollow elongated shaft having spaced opposite first and second ends 2 and 3 (FIG. 2). A handle component 4, similar to that of the handlebar of a bicycle, is coaxially affixed to the shaft 1 around the first end 2 thereof, as shown in FIGS. 1 to 4.

The shaft 1 has a tapered bore 5 (FIGS. 2, 3 and 5) formed therein in the area of the second end 3 thereof and extending substantially radially.

A balance member 6 (FIGS. 1, 2, 4 and 5) has an elongated rod having spaced opposite first and second ends 7 and 8 (FIG. 2). The first end 7 of the rod 6 is tapered to seat in the bore 5 formed in the handle member 1.

The balance member 6 has a balance device 9 (FIGS. 1 to 4) affixed to the second end 8 of the rod. The balance device 9 is a knob-like weight to provide balance for the balance member.

The rod 6 fits in the shaft 1, as shown in FIG. 4, when not in use, with the balance device 9 protruding therefrom.

A user 10 attempts to balance the balance member 6 in upright position on the handle member 1 by placing the first end 7 of the rod in the bore 5 of the handle member, holding the handle member substantially horizontal, and positioning the balance member substantially upright, as shown in FIG. 1. The user may be tested for longevity or a number of people may compete to determine who maintains the balance member in upright position for the longest period of the time. Several variations may be followed such as, for example, having a number of contestants walk a specific obstacle course while attempting to balance their respective balance members.

While the invetion has been described by means of a specific example and in a specific embodiment, I do not wish to be limited thereto, for obvious modifications will occur to those skilled in the art without departing from the spirit and scope of the invention.

I claim:

1. An amusement device, comprising a handle member having a hollow elongated shaft having spaced opposite first and second ends, a handle component coaxially affixed to the shaft around the first end thereof, said shaft having a tapered bore formed therein in the area of the second end thereof and extending substantially radially; and a balance member having an elongated rod having spaced opposite first and second ends, the first end of the rod being tapered to seat in the bore formed in the handle member, and said balance member having a balance device affixed to the second end of the rod, said rod fitting in said shaft, when not in use, with the balance device protruding therefrom and whereby a user attempts to balance the balance member in upright position on the handle member by placing the first end of said rod in the bore of said handle member, holding said handle member substantially horizontal and positioning said balance member substantially upright.

* * * * *